US007992577B2

(12) United States Patent
De Brouwer et al.

(10) Patent No.: US 7,992,577 B2
(45) Date of Patent: Aug. 9, 2011

(54) INSTRUMENT FOR APPLYING A COMPOSITION ON THE EYELASHES OR EYEBROWS

(75) Inventors: Etienne Andre De Brouwer, Lassigny (FR); Eric Hoisnard, Ognes (FR); Eric Caulier, Maignelay Montigny (FR)

(73) Assignee: Yves Saint Laurent Parfums, Neuilly sur Seine (FR)

( * ) Notice: Subject to any disclaimer, the term of this patent is extended or adjusted under 35 U.S.C. 154(b) by 0 days.

(21) Appl. No.: 11/534,030

(22) Filed: Sep. 21, 2006

(65) Prior Publication Data

US 2007/0062552 A1 Mar. 22, 2007

(30) Foreign Application Priority Data

Sep. 21, 2005 (FR) ..... 05 09660

(51) Int. Cl.
*A45D 40/26* (2006.01)

(52) U.S. Cl. ..... 132/218

(58) Field of Classification Search ..... 132/216, 132/218, 317, 318, 320, 901, 270, 161; 401/126, 401/129

See application file for complete search history.

(56) References Cited

U.S. PATENT DOCUMENTS 4,635,659 A * 1/1987 Spatz ..... 132/218
6,440,557 B1 * 8/2002 Naghibi ..... 428/397
6,616,366 B1 * 9/2003 Weihrauch ..... 401/286
7,156,102 B2 * 1/2007 Ramet ..... 132/160
2001/0037815 A1 * 11/2001 Gueret ..... 132/218
2003/0213498 A1 11/2003 Gueret
2005/0034740 A1 2/2005 Eckers et al.

FOREIGN PATENT DOCUMENTS

EP 0244864 11/1987

* cited by examiner

*Primary Examiner* — Rachel R Steitz

(74) *Attorney, Agent, or Firm* — Jason A. Bernstein; Barnes & Thornburg LLP

(57) ABSTRACT

An instrument for applying a liquid or semi-liquid composition on the eyelashes or the eyebrows, comprising a core extending in an axial direction, and at least first, second, third, and fourth projections projecting from the core, wherein the first and second projections that form a first group of projections are mutually spaced apart by a first spacing to define a first interstitial gap in the form of a sheet extending at least locally in a plane that is substantially perpendicular to the axial direction, the first interstitial gap being shaped and dimensioned to retain the composition therein for the purpose of being applied to the eyelashes or the eyebrows, the third and fourth projections that form a second group of projections, being mutually spaced apart by a second spacing to define a second interstitial gap in the form of a sheet that extends at least locally in a plane that is substantially perpendicular to the axial direction, the interstitial gap being shaped and dimensioned to retain the composition therein for application on the eyelashes or eyebrows, the first and second groups being mutually spaced apart by a third spacing substantially greater than both the first and the second spacings.

27 Claims, 4 Drawing Sheets

A-A

INSTRUMENT FOR APPLYING A COMPOSITION ON THE EYELASHES OR EYEBROWS

PRIORITY CLAIM

This patent application claims priority to French Patent Application No. FR-05 09660, filed Sep. 21, 2005, the disclosure of which is incorporated herein by reference in its entirety.

FIELD OF THE INVENTION

The present invention relates to devices for applying compositions, in particular cosmetic compositions on hairs or nails, and in particular on hairs such as the eyelashes or eyebrow hairs.

The present invention relates to an instrument for applying a liquid or semi-liquid composition on the eyelashes or the eyebrows, the instrument comprising a core extending along an axial direction, together with at least first, second, third, and fourth projections extending from the core.

In its preferred application, the instrument in accordance with the invention constitutes a mascara applicator for the eyelashes, for taking a quantity of mascara from a receptacle and for transporting said quantity to the eyelashes in order to deposit it thereon.

BACKGROUND OF THE INVENTION

Mascara applicators are already known that are in the form of brushes. Conventionally, such brushes comprise a handle member that can also act as a stopper for a receptacle containing the mascara for application, together with a stem extending from the handle member between a proximal and a distal end.

A multitude of bristles project radially from the stem, at the distal end thereof, thus forming an applicator head.

Such prior art brushes are designed to be used as follows.

The user dips said brush in the receptacle containing mascara, thereby partially coating the bristles and the stem in mascara. The user then performs a brushing action on the eyelashes using the brush, thereby transferring mascara from the brush towards and onto the eyelashes.

Such known mascara brushes nevertheless present a certain number of drawbacks.

Firstly, prior art brushes generally do not make it possible to control the quantity of mascara they collect from inside the receptacle.

In some cases, the brush thus does not enable a sufficient quantity of mascara to be collected, such that the user must keep on dipping the brush into the receptacle, which can be inconvenient and can lead to risks of the stock of mascara contained in the receptacle becoming polluted or even contaminated. In addition, brushing the eyelashes with a brush that carries insufficient mascara can be particularly disagreeable or even painful because of the friction caused thereby.

In other cases, in particular when the mascara is very viscous or thick, after the brush has been dipped in the supply it can become overfilled with mascara. This means that the brush takes too great a quantity of mascara to the eyelashes in comparison with the eyelash area for covering. This can lead to poor-quality makeup, when a large fraction of this excess mascara is transferred onto the eyelashes, forming unattractive clumping between and on the eyelashes. Furthermore, given that all of the excess mascara is not transferred in full onto the eyelashes, the unused mascara that has remained on the brush is reinserted into the supply of mascara within the receptacle, thereby increasing the risk of the supply becoming dirtied and contaminated. In addition, this leftover mascara that has remained on the brush tends to dry out on the brush, which in the long run reduces the applicator qualities of the brush and degrades the supply of mascara contained in the receptacle by mixing dry mascara particles in with that supply.

Finally, prior art brushes do indeed enable the eyelashes to be combed while mascara is being applied, but as a general rule the combing function is not sufficient for obtaining continuous, uniform, and smooth coating of the eyelashes.

SUMMARY OF THE INVENTION

Consequently, the feature provided by the invention is to remedy the various drawbacks specified above and to propose a novel instrument for applying a liquid or semi-liquid composition on the eyelashes or the eyebrows that makes it possible both to collect accurately an appropriate quantity of mascara, while avoiding overloading the instrument with composition, and to apply said mascara in substantially uniform manner on the eyelashes, in a manner that is particularly smooth and while performing movements that are conventional.

Another feature of the invention is to propose a novel instrument for applying a liquid or semi-liquid composition on the eyelashes or the eyebrows, the instrument being of structure that is particularly simple and inexpensive.

Another feature of the invention is to propose a novel instrument for applying a liquid or semi-liquid composition on the eyelashes or the eyebrows, enabling excellent results to be obtained in terms of the appearance of eyelash or eyebrow makeup.

Another feature of the invention is to propose a novel instrument for applying a liquid or semi-liquid composition on the eyelashes or the eyebrows, providing a sensation of contact with the eyelashes or the eyebrows that is particularly gentle and flexible.

Another feature of the invention is to propose a novel instrument for applying a liquid or semi-liquid composition on the eyelashes or the eyebrows that, while being very simple in structure, makes it possible to control accurately the quantity of mascara that is picked up, and to separate, lengthen, and curve the eyelashes in improved manner.

Another feature of the invention is to propose a novel instrument for applying a liquid or semi-liquid composition on the eyelashes or the eyebrows that enables the eyelashes to be smoothed in substantially uniform manner.

Another feature of the invention is to propose a novel instrument for applying a liquid or semi-liquid composition on the eyelashes or the eyebrows that is of visual appearance that is generally comparable with that of conventional instruments of the prior art, so that the user knows intuitively how to use it.

The features provided by the invention are achieved with the help of an instrument for applying a liquid or semi-liquid composition on the eyelashes or the eyebrows, the instrument comprising a core extending in an axial direction, and at least first, second, third, and fourth projections projecting from the core, wherein the first and second projections that form a first group of projections are mutually spaced apart by a first spacing to define a first interstitial gap in the form of a sheet extending at least locally in a plane that is substantially perpendicular to the axial direction, said first interstitial gap being shaped and dimensioned to retain the composition therein for the purpose of being applied to the eyelashes or the eyebrows, the third and fourth projections that form a second group of projections, being mutually spaced apart by a second spacing to define a second interstitial gap in the form of a sheet that extends at least locally in a plane that is substantially perpendicular to the axial direction, said interstitial gap being shaped and dimensioned to retain the composition therein for application on the eyelashes or eyebrows, the first and second groups being mutually spaced apart by a third spacing substantially greater than both the first and the second spacings.

BRIEF DESCRIPTION OF THE DRAWINGS

Other advantages and features of the invention appear in greater detail on reading the following description and from the accompanying drawings provided in purely explanatory and non-limiting manner, in which.

DESCRIPTION OF THE INVENTION

Figure 1:
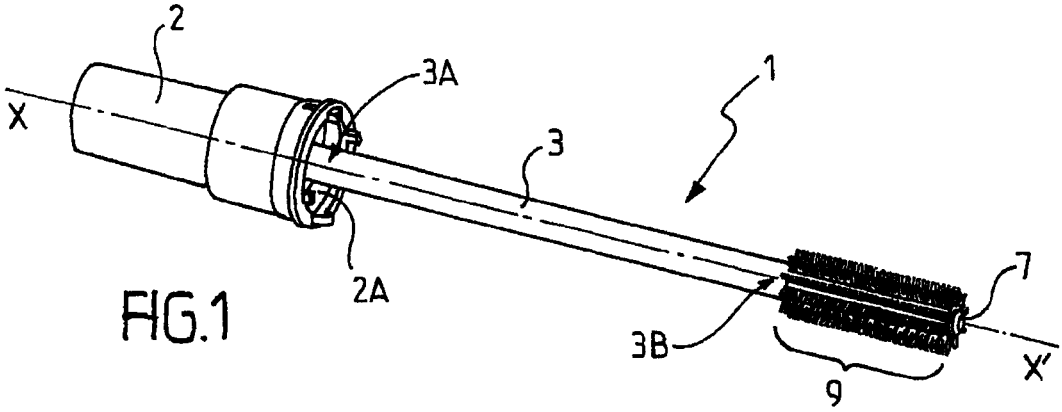
FIG. 1 is a general perspective view of a first embodiment of an instrument in accordance with the invention.
Figure 2:
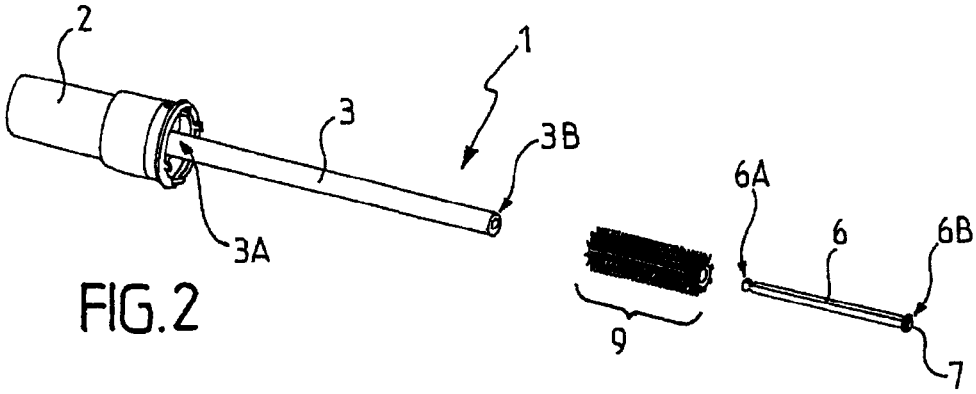
FIG. 2 is an exploded view showing the general principle whereby the instrument shown in FIG. 1 is constructed.
Figure 3:
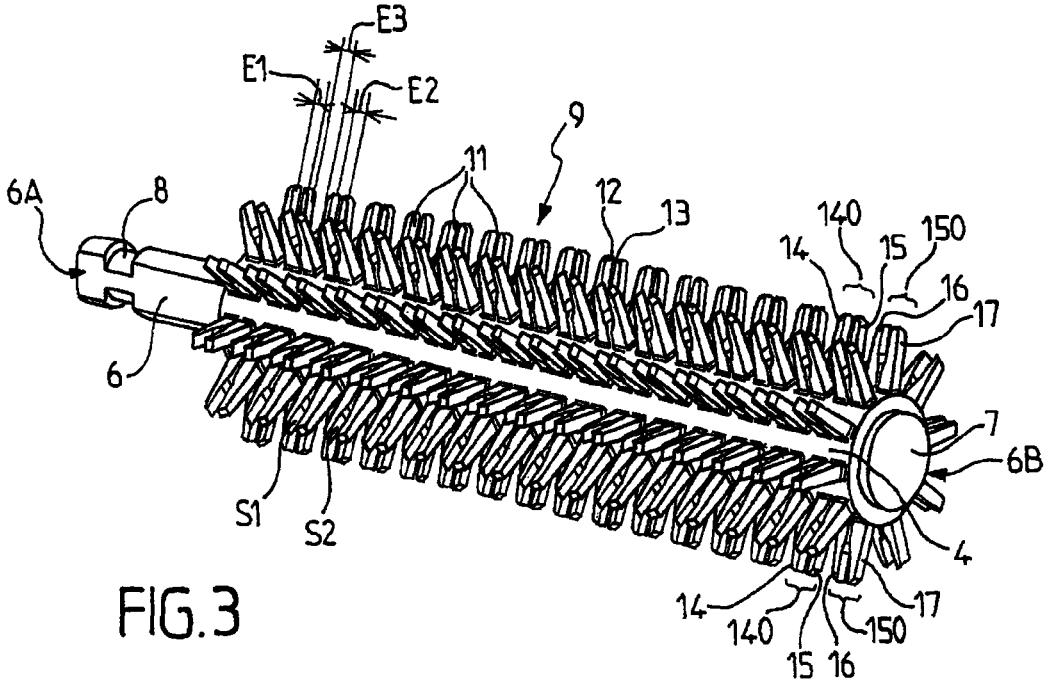
FIG. 3 is another perspective view showing an implementation detail of the instrument shown in FIGS. 1 and 2.

FIGS. 1 and 2 show an instrument 1 in accordance with the invention for applying a liquid or semi-liquid composition on the eyelashes or the eyebrows, the instrument being shown respectively in an assembled state and a disassembled state.

Advantageously, the composition for application is a cosmetic, such that the instrument 1 then constitutes a cosmetic instrument.

Preferably, the composition for application is mascara for the eyelashes, with the instrument 1 then constituting an instrument for applying mascara to the eyelashes.

In order to simplify the description, reference is made below solely to such a mascara applicator. Nevertheless, the invention is not limiting to applying a composition that is exclusively cosmetic in nature, nor to applying a composition that necessarily presents properties identical to those of a mascara. Thus, the instrument 1 may be used for applying any composition that is liquid or semi-liquid, regardless of its consistency, which composition may optionally be very fluid, or conversely may present the characteristic of being very viscous and pasty.

In known manner, the instrument 1 comprises a handle member 2 designed to be held and manipulated in the hand of a user, e.g. between two or three fingers. In conventional manner, the instrument 1 thus presents the characteristic of being portable and it is intended to be used in the hand.

Preferably, the handle member 2 also serves as a stopper for a receptacle (not shown) containing a supply of the composition for application, which composition is preferably mascara for the eyelashes.

To this end, the handle member 2 may be provided with tapping 2A designed to co-operate with a complementary thread (not shown) extending around the opening of the receptacle that is to be closed. Such an arrangement is conventional, and is therefore not described in greater detail below.

Advantageously, the instrument 1 includes a stem 3 extending in substantially rectilinear manner from the handle member 2 between a proximal end 3A and a distal end 3B.

In accordance with the invention, the instrument 1 includes a core 4 which is preferably located towards the distal end 3B of the stem 3.

The core 4 advantageously extends in an axial direction X-X', preferably in substantially rectilinear manner from the distal end 3B and in line with the stem 3. In the example shown in the figures, the core 4 is separate from the stem 3.

Nevertheless, it is entirely possible to envisage the core 4 being formed directly by the stem 3 itself.

It is also possible to envisage the core 4 extending in a manner that is not strictly rectilinear, as shown in the figures, but for example presenting a shape that curves slightly, and that is complementary to the profile presented by the eyelashes. Under such circumstances, the axial direction X-X' is clearly not defined by a straight line, but by a curved line that follows the outline along which the core 4 extends.

The core 4 is preferably elongate and slender in shape. In other words, the core 4 is advantageously long and thin in shape, i.e., extending for the most part in a single direction in three dimensions. In this respect the core 4 can be thought of as being one-dimensional.

Preferably, and as shown in FIGS. 1-3 and 10, the core 4 is in the form of a single piece.

Nevertheless, and as shown in FIGS. 4-9, it is also possible to envisage the core 4 being made up of at least two distinct individual pieces 4A, 4B, 4C, and 4D that are independent, being disposed end to end continuously and in line with one another.

Figure 4:
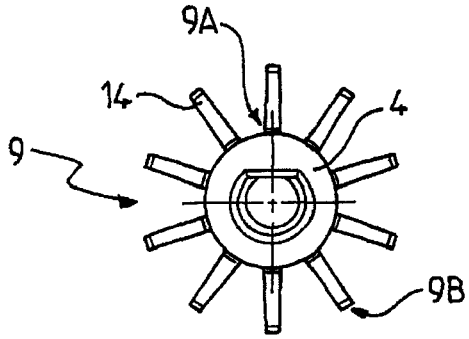
FIG. 4 is an end view showing an implementation detail of an instrument in accordance with a second exemplary embodiment.
Figure 5:
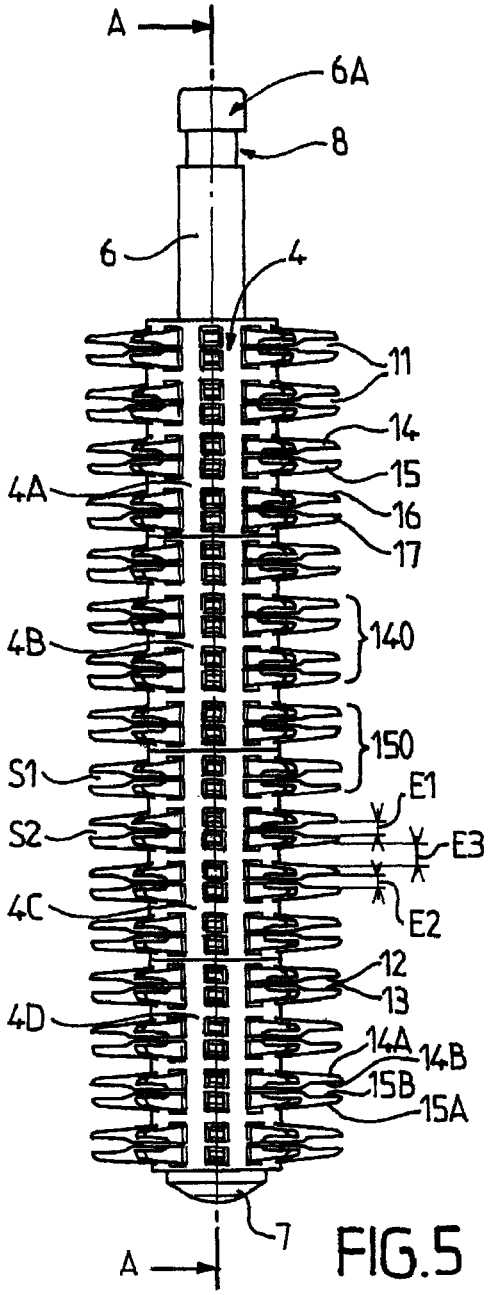
FIG. 5 is a plan view showing the implementation detail shown in FIG. 4.
Figure 6:
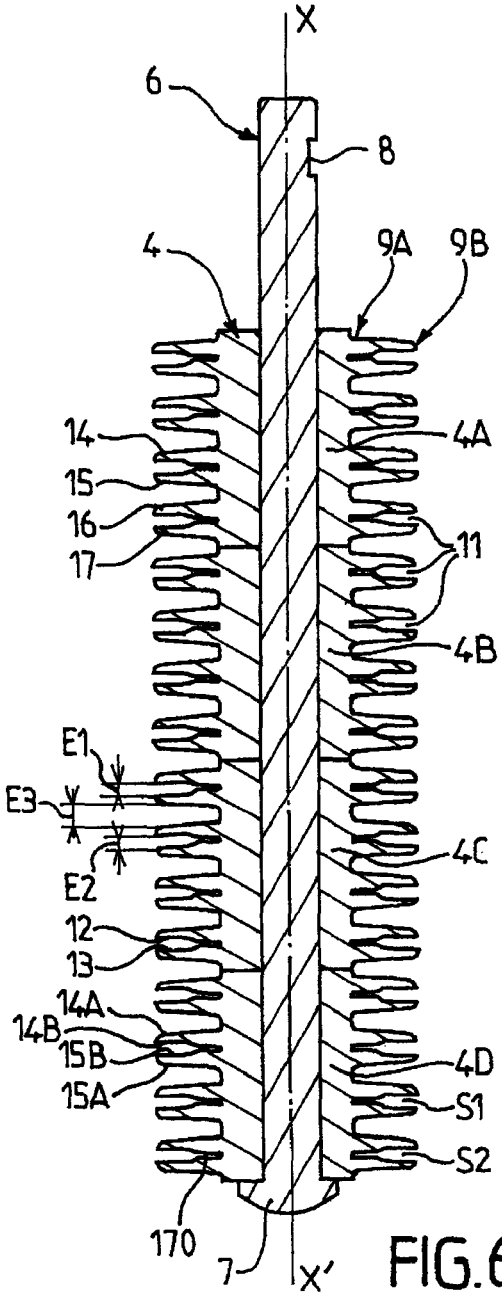
FIG. 6 is a side view in section on line A-A showing the detail of the instrument shown in FIG. 5.
Figure 7:
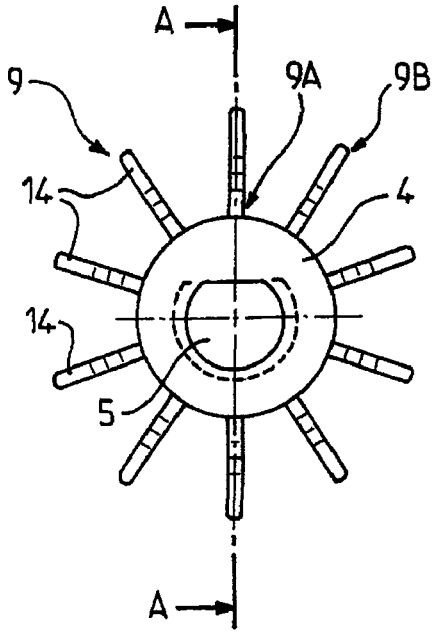
FIG. 7 is an end view showing an implementation detail of an instrument in accordance with a third exemplary embodiment of the invention.
Figure 8:
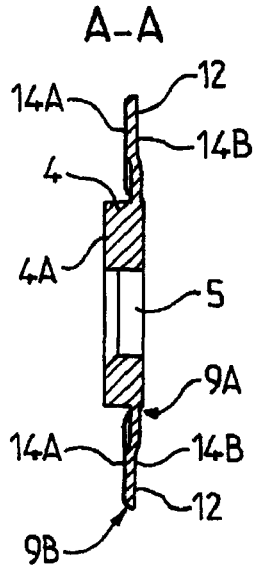
FIG. 8 is a diagrammatic side view in section showing the detail of FIG. 7.
Figure 9:
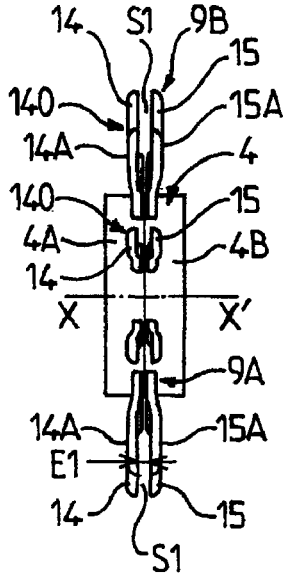
FIG. 9 is a diagrammatic side view showing how the third exemplary embodiment of the invention is made.
Figure 10:
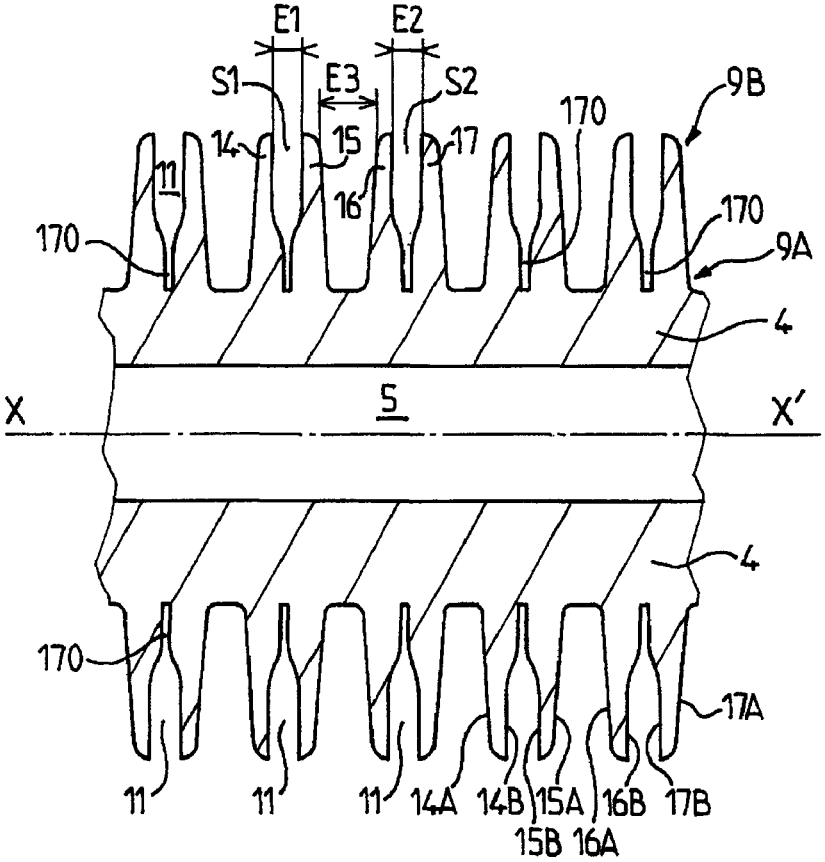
FIG. 10 is a diagrammatic side view in section showing an implementation detail of the instrument shown in FIGS. 1-3.
Figure 11:
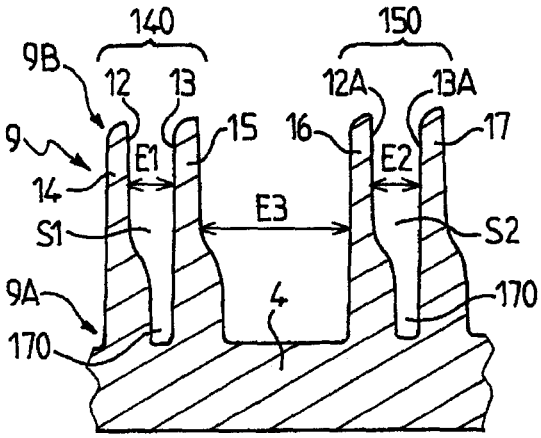
FIG. 11 is a diagrammatic side view in section showing an implementation detail of a fourth exemplary embodiment of the invention.

In the exemplary embodiment of FIGS. 4-6, the core 4 is thus made up of a stack of four distinct individual pieces 4A, 4B, 4C, and 4D.

In an embodiment that is particularly advantageous and that is shown in the figures, the core 4 is in the form of a single piece (cf. FIGS. 1-3) or a plurality of pieces (cf. FIGS. 5-9), each piece being long and slender and pierced along its entire length by a through hole 5. The core 4 is preferably substantially cylindrical in shape, preferably on a base that is circular, with the hole 5 being formed in its center.

In this variant, the core 4 forms a sheath that is to be threaded onto a pin 6 extending between a first end 6A and a second end 6B. The sheath forming the core 4 is designed to be threaded onto the pin 6 via the first end 6A, with the second end 6B being provided with abutment means 7 against which the sheath is designed to bear. In the embodiment shown in FIGS. 1-3, the abutment means 7 may be constituted merely by a disk formed integrally with the shank of the pin 6 and of diameter greater than the diameter of the hole 5. In the exemplary embodiment of FIGS. 4-6, the abutment means 7 is more elaborate and is constituted by a converging head, e.g. of conical shape, provided with projections 70 that are designed to make it easier to apply makeup to the corner of the eye.

The other end 6A of the pin 6 is advantageously provided with means for fastening to the distal end 3B of the stem 3. By way of example, and as shown in the figures, the first end 6A may include a groove 8, with the first end 6A being designed to be inserted into an orifice formed axially in the stem 3. Final assembly is then implemented by crimping the stem onto the pin 6, where said crimping is obtained by deforming the material constituting the stem 3 centripetally into the groove 8.

In accordance with one exemplary embodiment of the invention, the instrument comprises at least first, second, third, and fourth projections 14, 15, 16, and 17 that project from the core 4. In other words, each projection 14, 15, 16, and 17 projects relative to the core 4 and forms a protuberance extending from said core 4. Each projection 14, 15, 16, and 17 preferably extends radially relative to the axis of symmetry X-X' of the core 4.

The projections 14, 15, 16, and 17 thus advantageously form applicator means 9 designed to collect the composition and apply it to the eyelashes (or to eyebrow hairs). The applicator means 9 formed by the projections 14, 15, 16, and 17 are thus specifically designed to take the composition for application, e.g. by being immersed in a supply thereof, and for retaining and containing said quantity of substance that has been taken until it is released on the eyelashes, with release preferably being performed by putting the applicator means 9 into contact with the eyelashes and by rubbing them thereagainst.

The applicator means 9 formed by the projections 14, 15, 16, and 17 consequently project from the core 4 between respective bases 9A and tips 9B. Each base 9A corresponds to the individual base of each projection, while each tip 9B corresponds to the individual tip of each projection.

In accordance with the invention, the first and second projections 14, 15 that form a first group 140 of projections are mutually placed apart by a first spacing E1 so as to define a first interstitial gap S1 in the form of a sheet. In other words, the first interstitial gap S1 is an empty space presenting substantially the shape of a two-dimensional thin and flat band that could also be said to be "plate"-shaped.

In the examples shown in the figures, the first and second projections 14, 15 are aligned substantially parallel to the axial direction X-X' such that the spacing E1 that corresponds to the thickness of the sheet-shaped gap S1 is measured in the axial direction X-X'.

In accordance with the invention, the sheet-shaped first interstitial gap S1 extends at least locally in a plane that is substantially perpendicular to the axial direction X-X'. In other words, in projection as seen from above (see for example FIGS. 13-16), the first interstitial gap S1 extends in a general direction that is substantially orthogonal to the direction X-X'. Thus, the interstitial gap S1 and the core 4 extend locally, e.g., where the projections 14, 15 join the core 4, substantially in two intersecting planes that are substantially orthogonal.

In accordance with the invention, the first interstitial gap S1 is shaped and dimensioned so as to retain composition therein for the purpose of applying it on the eyelashes (or on eyebrow hairs). In particular, the first interstitial gap S1 defines an applicator volume 11 that is shaped and dimensioned firstly to contain the composition for application and secondly, in preferred manner, to enable at least one eyelash (or eyebrow hair) to pass therethrough in order to be coated in composition.

In other words, the interstitial gap S1 forms a cavity, at least part of which forms a receptacle corresponding to the applicator volume 11 that is designed to collect, contain, and retain the composition for application.

In particular, the interstitial gap S1 preferably forms a vesicle which, when immersed in a supply of the liquid (or semi-liquid) composition for application, becomes filled with said composition and retains it therein by a capillarity and/or surface-tension mechanism.

The first interstitial gap S1 and its associated applicator volume 11 are thus dimensioned and shaped specifically relative to the physico-chemical characteristics of the composition for application, and in particular relative to its viscosity and its consistency, so that each applicator volume 11 effectively retains a predetermined quantity of the composition therein, regardless of the orientation of the volume 11 in three dimensions.

In order to allow at least eyelash to pass through the interstitial gap S1 so as to be coated in composition, the gap S1 presents over at least a fraction of its total extent a dimension E1 that is preferably greater than the size (diameter) of an eyelash (or an eyebrow hair).

Preferably, and as shown in the figures, the applicator volume 11 opens to the outside so as to enable eyelashes to penetrate therein directly when the eyelashes are subjected to a brushing action by means of the instrument 1.

In accordance with the invention, the third and fourth projections 16, 17 that form a second group of projections 150, are mutually spaced apart by a second spacing E2 to define a second interstitial gap S2 in the form of a sheet that extends at least locally in a plane that is substantially perpendicular to the axial direction X-X', said second interstitial gap being shaped and dimensioned to retain the composition therein in order to apply it to the eyelashes or the eyebrows.

The details of the above description relating to the first group 140 thus apply likewise to the second group 150 and are not described in full again below. In other words, the first and second groups 140 and 150 present general designs that are substantially similar, which naturally does not exclude them having structures that are different.

Advantageously, each of the first and second interstitial gaps S1 and S2 is substantially rectangular in shape as can be seen in FIGS. 1-14 and 17. Nevertheless, it is possible to envisage said interstitial gaps S1 and S2 being of some other shape, for example presenting a shape having a central constriction (cf. FIG. 15), a shape that is curved (cf. FIG. 16), or indeed an undulating shape (not shown).

Advantageously, the projections 14, 15, 16, and 17, and thus the applicator means 9, are made integrally with the core 4. In other words, in this advantageous configuration which is implemented in all of the embodiments shown in the figures, the projections 14, 15, 16, and 17 and the core 4 form a single unitary subassembly.

In preferred manner, the core 4 and the projections 14, 15, 16, and 17 are obtained in a single operation of injection molding a plastics material, preferably an elastomer or a polymer of the polytetrafluoroethylene (PTFE) kind. The invention thus lends itself particularly well to manufacture by injection molding plastics material, which is fast and inexpensive. Naturally, the invention is not limited to an instrument 1 implementing applicator means 9 molded integrally with the core 4. The applicator means 9 could be distinct from the core 4 and could be secured thereto by any appropriate means, e.g. by adhesive, heat-sealing, or mechanical assembly.

In an alternative embodiment that is not shown, it is also possible to envisage the core 4 being made without a central orifice 5, but directly together with a portion of pin that projects from one of its ends for the purpose of interacting with a corresponding hole formed in the distal portion 3B of the stem 3. In this advantageous embodiment, the applicator means 9 (comprising the projections 14, 15, 16, and 17), the core 4, and the portion of pin 6 are made simultaneously in a single injection-molding operation.

In preferred manner, and as can be seen in particular in FIGS. 1-6, the instrument 1 has a plurality of projections 14, 15, 16, and 17 that co-operate in pairs, each pair forming a group 140 or 150, and each group 140, 150 defining a corresponding applicator volume 11.

Advantageously, at least the first, second, third, and fourth projections are substantially in alignment, preferably parallel to the axial direction X-X'. Said projections thus form rows. As can be seen in the figures, the instrument 1 advantageously presents a plurality of similar rows extending parallel to the axial direction X-X' and disposed at regular angular intervals around the periphery of the core 4, which itself preferably presents a section that is substantially circular.

Thus, the invention enables at least two and preferably a multitude of applicator volumes 11 to be created that are specially adapted to retain the composition for application. Furthermore, having the interstitial gaps S1, S2 oriented perpendicularly relative to the axis X-X', i.e. oriented in a direction that corresponds in use to the direction in which the eyelashes extend, makes it possible to optimize the way in which the eyelashes are sheathed by the composition during application.

In accordance with an important characteristic of the invention, the first and second groups 140 and 150 are spaced apart mutually by a third spacing E3 that is substantially greater both than the first spacing E1 and than the second spacing E2. In other words, the distance between the two groups 140 and 150, in particular in the axial direction X-X', is greater than the distance between two projections within a single group. This characteristic serves to minimize any retention of composition between the groups, while on the contrary encouraging evacuation of the composition from between the groups 140 and 150. In this way, the composition for application is preferably concentrated within each of the groups 140 and 150 within the corresponding interstitial gaps S1, S2 and does not accumulate uselessly in zones that are not intended for direct interaction with the eyelashes. This enables the instrument to be loaded in controlled and optimized manner with the composition for application, thereby facilitating and improving the application of makeup, while limiting any risk of the instrument 1 being degraded and/or any risk of the supply of composition being dirtied and contaminated.

Advantageously, the third spacing E3 is specifically dimensioned so as to prevent any of the composition for application accumulating in the gaps that exist between the groups 140 and 150. This technical effect can be made more or less intense depending on the magnitude of the spacing E3.

Having a third spacing E3 that is greater than the first and second spacings E1 and E2 also serves to improve combing of the eyelashes.

Advantageously, one or the other (or both) of the spacings E1 and E2 lies in the range approximately 0.1 millimeters (mm) to 2 mm, and more preferably in the range 0.3 mm to 0.7 mm, with preferred values lying in the range 0.4 mm to 0.5 mm, the limits of this preferred range giving excellent results.

It should be observed that for the embodiments shown in FIGS. 1-10, the first and second spacings E1 and E2 should be measured in a top zone of the corresponding interstitial gap S1, S2, given that said interstitial gap S1, S2 co-operates towards the bases 9B of the applicator means 9 to define gaps 170 of small size (e.g., lying in the range 0.05 mm to 0.4 mm, and preferably equal to about 0.1 mm), which gaps are not directly intended for containing and retaining the composition, but rather for allowing improved bending of each projection 14, 15. The gap 170 is thus preferably dimensioned relative to the physico-chemical properties (in particular viscosity of surface tension) of the composition for application in such a manner as prevent, or at least limit, penetration of the composition therein. The gap 170 may also be selected to be smaller than the diameter of an eyelash, so as to prevent an eyelash penetrating therein.

Figure 17:
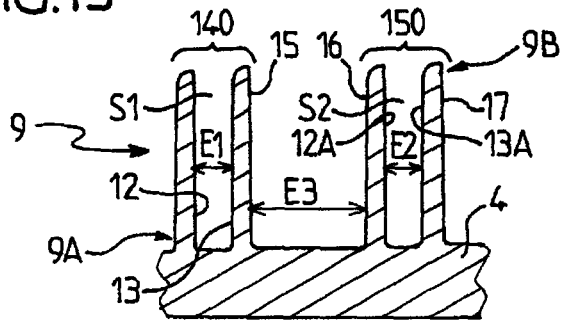
FIG. 17 is a diagrammatic side view in section showing an implementation detail of a tenth exemplary embodiment of the invention.

In the variant shown in FIG. 17, the first and second interstitial gaps S1 and S2 are substantially constant in section over the entire length of the corresponding projections 14, 15, 16, and 17, such that the spacings E1 and E2 can be measured at any radial distance from the core 4.

In general, the first and second spacings E1 and E2 correspond to the characteristic dimension of the first and second interstitial gaps relative to the function of retaining and applying the composition on the eyelashes as described above.

Preferably, the first and second spacings E1 and E2 are substantially equal. Nevertheless, without going beyond the ambit of the invention, it is entirely possible to envisage the first and second spacings E1 and E2 being different, insofar as the first and second interstitial gaps S1 and S2 that they define both perform the above-described function of retaining the composition.

Advantageously, the third spacing lies substantially in the range 0.2 mm to 4 mm.

In preferred manner, the third spacing is equal to substantially twice the first and second spacings E1, E2, with the first and second spacings E1 and E2 being equal. Selecting such a ratio turns out to present an excellent compromise in terms of capacity to retain composition in the applicator volumes 11 and discharging composition from between the groups 140, 150.

In a particularly preferred variant, each of the first and second spacings E1 and E2 is substantially equal to 0.4 mm, while the third spacing E3 is substantially equal to 0.8 mm.

Advantageously, each projection 14, 15 is formed by a flexible blade, preferably made of an elastomer material or a polymer material, e.g., of the PTFE (polytetrafluoroethylene) kind.

Advantageously, each blade presents a cross-section that is substantially polygonal in shape, preferably being substantially rectangular as shown in FIGS. 1-12 and 17, or lozenge-shaped (FIG. 15), or hexagonal (FIG. 14), for example. Sections of other shapes could naturally be envisaged, and for example and in non-limiting manner, shapes constituting portions cut from disks by lines that are straight (FIG. 13) or curved (FIG. 16).

Each blade preferably performs two functions since it contributes firstly to forming an interstitial gap in association with at least one other blade, and secondly it forms a tooth suitable for combing the eyelashes.

Figure 12:
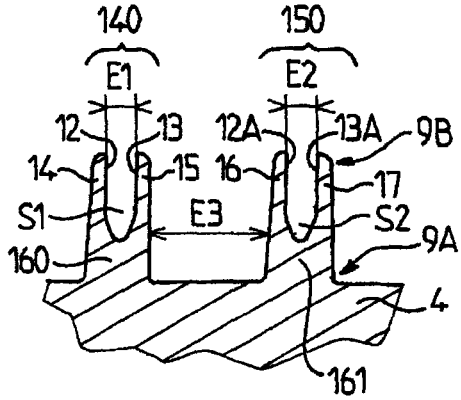
FIG. 12 is a diagrammatic side view in section showing an implementation detail of a fifth exemplary embodiment of the invention.
Figure 13:
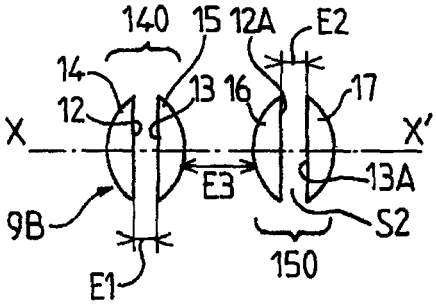
FIG. 13 is a diagrammatic plan view showing implementation details of a sixth exemplary embodiment of the invention.
Figure 14:
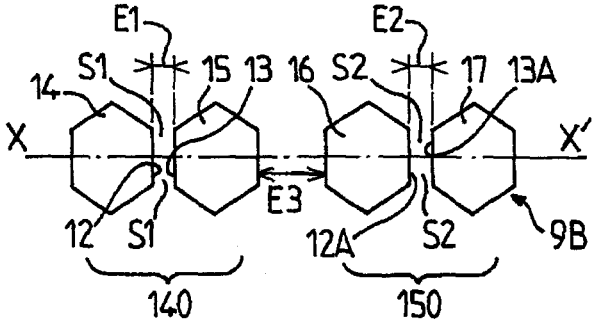
FIG. 14 is a diagrammatic plan view showing implementation details of a seventh exemplary embodiment of the invention.

In the exemplary embodiment shown in FIG. 12, each pair of projections 14, 15, 16, and 17 in a given group 140, 150 comes from a single common root 160, 161 which becomes subdivided going from the base 9A towards the tips 9B so as to form two arms respectively constituting the two projections 14, 15, 16, and 17 of a given group 140, 150.

In the embodiments shown in particular in FIGS. 1-11 and 17, which embodiments are preferred embodiments, the first and second projections 14, 15 of the first group 140, and the third and fourth projections 16, 17 of the second group 150, extend from the core 4 separately from one another, i.e., the projections within a given group are substantially totally distinct over their entire length. This technical characteristic enables the individual characteristics of flexibility to be improved for each of the projections 14, 15, 16, and 17, thereby improving the comfort with which makeup can be applied by encouraging contact between the instrument 1 and the eyelashes that is flexible, and enables the eyelashes to be combed effectively. This preferred variant thus achieves an excellent compromise between quantitative and positional control over the quantity of composition that is collected and retained by the instrument 1, and the capacity of the instrument to perform combing.

Advantageously, the first and second projections define respective first and second walls 12, 13 disposed substantially facing each other so as to form the first interstitial gap S1, each of said walls 12, 13 being substantially two-dimensional in nature, i.e., each wall extending in substantially two directions of three-dimensional space with respective orders of magnitude that are comparable. The walls 12, 13 thus advantageously form two plane faces placed in register with each other and defining an empty gap that is itself in the form of a sheet. This technical measure is preferred since it provides improved retention of the composition between the blades, and also improves coating of the eyelashes in the composition when an eyelash is engaged in an applicator volume 11, with the applicator volume then being moved along the eyelash under the effect of the brushing movement performed by the user. In similar manner, the third and fourth projections 16, 17 also preferably define respective third and fourth walls 12A, 13A disposed substantially facing each other so as to form the second interstitial gap S2, each of said walls 12A, 13A being substantially two-dimensional in nature, like the first and second walls 12, 13.

As shown in the figures, each projection 14, 15, 16, and 17 presents an outside face 14A, 15A, 16A, and 17A and an inside face 14B, 15B, 16B, and 17B opposite therefrom, said inside faces 14B, 15B, 16B, and 17B being disposed facing one another within a given group 140, 150, and contributing to forming the first and second walls 12, 13, 12A, 13A, respectively.

In order specifically to obtain better control over the quantity of composition that is collected by the applicator means 9 and retained in each applicator volume 11, and in order specifically to avoid transferring the composition out from the applicator volumes 11 towards zones of the instrument 1 that are not intended to interact directly with the eyelashes, the first and second walls 12, 13, 12A, 13A are substantially solid.

The term "substantially solid" is used herein to mean that each wall forms a substantially continuous piece of material, in contrast in particular to walls made by uniting discrete elements, and in particular by uniting fibers or bristles disposed beside one another. In other words, each wall 12, 13, 12A, 13A is substantially unitary in character, and is also continuous and constitutes a single piece.

As mentioned above, the solid walls 12, 13, 12A, 13A face each other in pairs within a given group, i.e. they are in register with one another.

Preferably, each of the first and second walls 12, 13, 12A, 13A presents at least one surface that is substantially plane, said substantially plane surfaces being disposed substantially parallel to one another, as can be seen in particular in FIGS. 1-14, 16, and 17.

Naturally, the invention is not limited to implementing an applicator volume 11 that is defined solely by two plane faces, and the applicator volume could be defined by faces presenting any other geometrical outline, and for example presenting a plurality of plane facets (cf. FIG. 15), or indeed an outline that is substantially curved (cf. FIG. 16).

Figure 15:
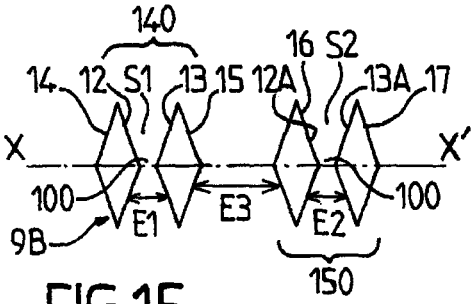
FIG. 15 is a diagrammatic plan view showing implementation details of an eighth exemplary embodiment of the invention.
Figure 16:
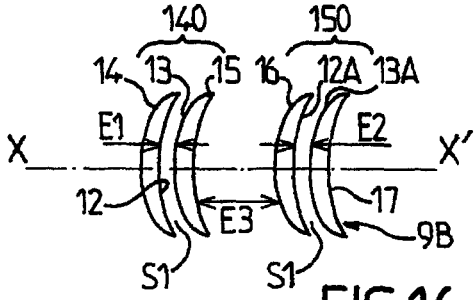
FIG. 16 is a diagrammatic plan view showing implementation details of a ninth exemplary embodiment of the invention.

Thus, the first and second walls 12, 13, 12A, 13B could instead be disposed in symmetrical or mirror manner as in the exemplary embodiment shown in FIG. 15 where each projection 14, 15, 16, and 17 is lozenge-shaped in section, with each interstitial gap S1, S2 thus presenting a constriction 100 of section in its center, said constriction 100 lying between two segments that diverging going away therefrom.

In preferred manner, each of the first and second walls 12, 13, 12A, 13A presents a surface that is substantially smooth and regular, that is preferably free from any geometrical irregularities or roughness, thereby further improving the effects of smoothing and/or coating the eyelashes, as mentioned above.

The invention operates as follows.

The user grasps the handle member 2 in the hand while it is screwed on a mascara receptacle (not shown).

After unscrewing the member 2, the user pulls on the instrument 1 in order to extract the applicator means 9 from the supply of mascara in which it was immersed.

After passing through a wiper, e.g., constituted by an orifice of section that is small compared with the radial size of the applicator means 9, the applicator means 9 reaches the open air where it is ready for being put into contact with the eyelashes. In each applicator volume 11 formed by the blades of the instrument 1, there is to be found a controlled and predetermined quantity of mascara.

The spacing E3 between groups 140 and 150 of blades is preferably designed to minimize retention of mascara and to encourage mascara to be discharged therefrom. The mascara is thus contained preferably and for the most part in the applicator volumes 11.

The user then performs a combing action on the eyelashes by means of the projections 14, 15, 16, and 17, with the axis of symmetry X-X' of the instrument 1 extending substantially perpendicularly to the direction in which the eyelashes extend while the combing action is being performed.

During combing, the eyelashes penetrate, preferably individually, into the applicator volumes 11, thus picking up mascara. Because of the presence of the sheets of composition in the applicator volumes 11, each eyelash is coated and smoothed individually by the composition in an applicator volume 11.

Each flexible blade also contributes to ensuring that the eyelashes are well separated from one another.

To sum up, it has been found that the instrument 1 in accordance with the invention makes it possible to perform the following four functions in improved manner: separating the eyelashes; lengthening the eyelashes; curving the eyelashes; and coating the eyelashes in mascara in order to obtain a "volume" effect.

To this end, the dimensions E1, E2 of each applicator volume 11 in the axial direction X-X', and the spacing E3 between said applicator volumes 11, are selected as a function of the physical spacing between the eyelashes so as to ensure that the eyelashes are preferably and as much as possible engaged individually in respective applicator volumes 11.

The invention claimed is:

1. An instrument for applying a liquid or semi-liquid composition on the eyelashes or the eyebrows, the instrument comprising:

a) a generally cylindrically shaped core having a periphery and extending in an axial direction and having a cylindrical external surface and a central axis;

b) at least one elongated first projection projecting radially outward from the surface of the core and in a direction emanating from an imaginary point at the central axis;

c) at least one elongated second projection projecting radially from the surface of the core and in a direction emanating from an imaginary point at the central axis;

d) at least one elongated third projection radially from the surface of the core and in a direction emanating from an imaginary point at the central axis;

e) at least one elongated fourth projection projecting radially from the surface of the core and in a direction emanating from an imaginary point at the centrally axis;

f) a first group of projection comprising the at least one first projection and the at least one second projections, the first group of projections being arranged in a plurality of arcs spaced around at least half of the periphery of the core such that the first group of projections in a given arc extends from the surface of the core in a nonparallel direction in relation to an adjacent first group of projections in the same arc, and wherein an adjacent first projection and second projection in the same arc are mutually spaced apart by a first spacing defining a first interstitial gap in the form of a hypothetical sheet extending at least locally in a first infinite plane that is substantially perpendicular to the axial direction, each first and second projection having an internal face wherein the first projection internal face is substantially parallel to the second projection internal face, the first interstitial gap being shaped and dimensioned to retain the composition therein for application on the eyelashes or the eyebrows; and g) a second group of projections comprising the at least own third projection and at least one fourth projection, the second group of projections being arranged in a plurality of arcs spaced around at least half of the periphery of the core such that the second group of projections in a given arc extends from the surface of the core in a nonparallel direction in relation to an adjacent second group of projections in the same arc, and wherein an adjacent third projection and fourth projection in the same arc are mutually space apart by a second spacing defining a second interstitial gap in the form of a hypothetical sheet extending at least locally in a second infinite plane that is substantially perpendicular to the axial direction, each third and fourth projection having an internal face wherein the third projection face is substantially parallel to the fourth projection internal face, the second interstitial gap being shaped and dimensioned to retain the composition therein for application on the eyelashes or eyebrows, wherein adjacent first and second projection in adjacent arcs from a row extending in a direction co-parallel with the axis of the core, wherein the first and second groups of projections are mutually spaced apart by a third spacing greater than either the first or the second spacing, the first and the second planes intersecting none of the projections, and wherein the first group and second group of projections and the core are formed as a single piece unit.

2. The instrument of claim 1, wherein the first, second, third, and fourth projections are substantially in alignment.

3. The instrument of claim 1, wherein the first and second spacings are substantially equal.

4. The instrument of claim 3, wherein the third spacing is equal to substantially twice the first or second spacing.

5. The instrument of claim 4, wherein the first spacing lies substantially in the range of 0.1 mm to 2 mm, as does the second spacing, while the third spacing lies substantially in the range of 0.2 mm to 4 mm, and wherein each of the first and second spacings is substantially equal to 0.4 mm, while the third spacing is substantially equal to 0.8 mm.

6. The instrument of claim 1, wherein the first spacing lies substantially in the range of 0.1 mm to 2 mm, as does the second spacing, while the third spacing lies substantially in the range of 0.2 mm to 4 mm.

7. The instrument of claim 1, wherein each of the first and second interstitial gaps is substantially rectangular in shape.

8. The instrument of claim 1, wherein the first and second projections define respective first and second walls disposed substantially facing each other to form the first interstitial gap, said first and second walls each being substantially flat.

9. The instrument of claim 8, wherein each of the first and second walls presents at least one substantially planar surface.

10. The instrument of claim 8, wherein each of the first and second walls presents a surface that is substantially smooth and regular.

11. The instrument of claim 8, wherein said first and second walls are disposed substantially parallel to each other.

12. The instrument of claim 1, wherein each projection is formed by a flexible blade.

13. The instrument of claim 1, wherein each projection presents a cross-section that is substantially polygonal in shape.

14. The instrument of claim 1, wherein the first and second projections extend from the core independently from the third and fourth projections.

15. The instrument of claim 1, wherein each projection presents a cross-section that is substantially rectangular.

16. The apparatus of claim 1, further comprising a quantity of mascara contained in receptacle.

17. The instrument of claim 1, wherein the third spacing extends in a plane which intersects none of the projections.

18. The instrument of claim 1, wherein the plurality of projections being disposed in at least two distinct rows, at least one projection of a first row having a free end pointing toward a first direction while at least one projection of a second row has a free end pointing toward a second direction which is different from the first direction.

19. The instrument of claim 18, wherein the first and second directions diverge.

20. The instrument of claim 1, wherein the at least one first, second, third and fourth projections are spaced around the surface of the core.

21. The instrument of claim 1, wherein the core has a generally cylindrical shape.

22. The instrument of claim 1, wherein the core has a generally round cross section.

23. The instrument of claim 1, wherein the core surface is curved.

24. The instrument of claim 1, wherein the first and second hypothetical sheets are parallel.

25. An instrument for applying a liquid or semi-liquid composition on the eyelashes or the eyebrows, the instrument comprising:

a) a generally cylindrically shaped core having a periphery and extending in an axial direction and having a cylindrical external surface and a central axis;

b) at least one elongated first projection projecting from radially outward from the surface of the core and in a direction emanating from an imaginary point at the central axis;

c) at least one elongated second projection projecting radially from the surface of the core and in a direction emanating from an imaginary point at the central axis;

d) at least one elongated third projection projecting radially from the surface of the core and in a direction emanating from an imaginary point at the central axis;

e) at least one elongated fourth projection projecting radially from the surface of the core and in a direction emanating from an imaginary point at the central axis;

f) a first group of projections comprising the at least one first projection and at least one second projection, the first group of projections being arranged in a plurality of arcs spaced around at least half of the periphery of the core such that the first group of projections in a given arc extends from the surface of the core in nonparallel direction in relation to an adjacent first group of projections in the same arc, and wherein an adjacent first projection and second projection in the same arc mutually space apart by a first spacing defining a first interstitial gap in the form of a hypothetical sheet extending at least locally in an infinite plane that is substantially perpendicular to the axial direction, each first and second projection having an internal face wherein the first projection internal face is substantially parallel to the second projection internal face, the first interstitial gap being shaped and dimensioned to retain the composition therein for application on the eyelashes or the eyebrows, and g) a second group of projections comprising the at least one third projection and the at least one fourth projections, the second group of projections being arranged in a plurality of arcs spaced around at least half of the periphery of the core such that the second group of projections in a given arc extends from the surface of the core in a nonparallel direction in relation to an adjacent second group of projections in the same arc, and wherein an adjacent third projection and fourth projection in the same arc mutually spaced apart by a second spacing defining a second interstitial gap in the form of a hypothetical sheet extending at least locally in an infinite plane that is substantially perpendicular to the axial direction, each first and second projection having an internal face wherein the first projection internal face is substantially parallel to the second projection internal face, the second interstitial gap being shaped and dimensioned to retain the composition therein for applications on the eyelashes or eyebrows, wherein adjacent first and second projections in adjacent arcs form a row extending in a direction co-parallel with the axis of the core, wherein the first and second groups of projections are mutually spaced apart by a third spacing greater than either the first or the second spacing, each group of projections consisting of two projections, and wherein the first group and second group of projections and the core are formed as a single piece unit.

26. An instrument for applying a liquid or semi-liquid composition on the eyelashes or the eyebrows, the instruments comprising:

a) a generally cylindrically shaped core having a central axis and having a cylindrically shaped external surface;

b) a plurality of pairs of elongated projections spaced around at least a portion of the surface of the core in a plurality of arcs, each pair of projections comprising a first projection and a second projection, each first projection and second projection projecting radially and orthogonally outward from the surface of the core and whereby adjacent first projections in the same arc are not parallel to each other, whereby adjacent pairs of projections in adjacent arcs form a row extending in a direction co-parallel with the axis of the core;

c) a first gap having a width defined by at least a portion of space between each first and second projection within a pair of first and second projections in the same arc, the first gap being dimensioned to retain composition therein for application on the eyelashes or the eyebrows; and, d) a second gap having a width defined by a space between adjacent pairs of first and second projections in a given row, whereby the second gap width is greater than the first gap width, and wherein the projections and the core are formed as a single piece unit.

27. The instrument of claim 26, wherein the second gap width is dimensioned to substantially prevent accumulation of composition.

* * * * *